United States Patent [19]

Morita

[11] 4,358,259

[45] Nov. 9, 1982

[54] ROTARY PISTON ENGINE SEALING MECHANISMS

[75] Inventor: Yasuyuki Morita, Hiroshima, Japan

[73] Assignee: Toyo Kogyo Co., Ltd., Hiroshima, Japan

[21] Appl. No.: 121,963

[22] Filed: Feb. 15, 1980

[30] Foreign Application Priority Data

Feb. 16, 1979 [JP] Japan ..... 54-19202[U]

[51] Int. Cl.[3] ..... F01C 19/04; F01C 19/08

[52] U.S. Cl. ..... 418/122; 418/142

[58] Field of Search ..... 418/113, 119–124, 418/142

[56] References Cited

U.S. PATENT DOCUMENTS

| | | | |
|---|---|---|---|
| 3,685,922 | 8/1972 | Lamm | 418/121 |
| 3,899,272 | 8/1975 | Pratt | 418/123 |
| 3,961,871 | 6/1976 | Kurio | 418/121 |
| 3,988,081 | 10/1976 | Goloff et al. | 418/142 |

FOREIGN PATENT DOCUMENTS

| | | | |
|---|---|---|---|
| 1170207 | 5/1964 | Fed. Rep. of Germany | 418/122 |

*Primary Examiner*—John J. Vrablik

*Attorney, Agent, or Firm*—Fleit & Jacobson

[57] ABSTRACT

An apex seal of a rotary piston engine comprising a sealing groove formed in each apex portion of the rotor, a sealing piece and a support piece disposed in the sealing groove with a superposed relationship. A corner seal at each end of the apex seal including a corner seal member formed with a longitudinally extending slit for receiving an adjacent end of the apex seal pieces. The slit in the corner seal member is generally wider than the sealing groove of the apex seal but has a minimum width portion that is narrower than the sealing groove. The minimum width slit portion is disposed against only one of the sealing and support pieces of the apex seal so that the sideward movement of the other piece is not disturbed by the corner seal member.

8 Claims, 6 Drawing Figures

ROTARY PISTON ENGINE SEALING MECHANISMS

The present invention relates to apex seals for rotary piston engines and more particularly to apex seals of a two-piece construction comprising an elongated sealing piece and an elongated support piece which are in a superposed relationship substantially throughout their lengths.

In the U.S. patent application which has been filed on Nov. 13, 1979 by Shimizu et al. and given with an unofficial serial number of Ser. No. 93,435, there is proposed an apex seal construction of the aforementioned type. The proposed type of apex seal is considered as being advantageous in that the sealing piece possesses a flexibility in radial direction of the rotor so that it can be engaged with the inner wall surface of the rotor housing with a substantially uniform pressure throughout its length even when the inner wall of the rotor housing is radially outwardly deformed due to a thermal expansion to provide a concave configuration as often experienced in a rotary piston engine. Further, it is noted that the support piece functions to suppress vibrations of the sealing piece. A further advantage of the above type of apex seal is that the arrangement provides an increased length of gas leakage path through the gap between the apex seal and the apex seal groove to thereby decrease gas leakage through the gap.

Such type of apex seal may be associated with a side piece at one or each end thereof as in conventional apex seals. Further, at each end of the apex seal, there may be provided a corner seal which generally comprises a cylindrical sealing member adapted to be fitted to a cylindrical bore formed in each corner portion of the side surface of the rotor. The sealing member of the corner seal has a longitudinally extending slit for receiving an end of the apex seal and resiliently forced into sliding engagement with the inner surface of the side housing.

Conventionally, such sealing member of the corner seal has been formed with the longitudinal slit for receiving an end of the apex seal larger in width than the apex seal groove and there has been noticeable amount of gas leakage through the gap between the apex seal and the slit of the corner seal member. In order to avoid such problem, the width of the slit in the corner seal member may be decreased so that it becomes narrower than the apex seal groove. However, such type of corner seal is not recommendable where the apex seal is of the aforementioned two-piece construction. In the apex seal of the two-piece construction, it is intended to force the sealing piece sidewardly in one direction into contact with one of the side walls of the apex seal groove and the support piece in the opposite direction into contact with the other of the side walls of the apex seal groove to thereby suppress the gas leakage through the gap between the apex seal and the seal groove. Such sideward forces may be applied to the apex seal pieces making use of the combustion gas pressure but the effects can further be enhanced by providing sidewardly slanted mating surfaces between the sealing and support pieces and forcing the support piece toward the inner wall surface of the rotor housing to produce sideward wedge forces. Where the corner seal member is of the type having a narrow longitudinal slit, the sideward movements of the sealing and support pieces of the apex seal may be disturbed by the wall of the slit so that the desired sealing function cannot be obtained.

It is therefore an object of the present invention to provide a novel combination of an apex seal of two-piece construction and a corner seal.

Another object of the present invention is to provide a corner seal for use with an apex seal of a two-piece construction.

Still further object of the present invention is to provide a combination of an apex seal of a two-piece construction and a corner seal which is so formed that it does not disturb the sideward movements of the apex seal pieces.

According to the present invention, the above and other objects can be accomplished by a rotary piston engine including a casing which comprises a rotor housing having an inner wall of trochoidal configuration and a pair of side housings having inner walls and secured to the opposite sides of the rotor housing to define a rotor cavity in the casing, a rotor of substantially polygonal configuration having opposite side surfaces and disposed in said rotor cavity for rotation with apex portions in sliding engagement with the inner wall of the rotor housing, apex seal means provided in each apex portion of the rotor and comprising a sealing groove formed in the rotor at the apex portion to extend in axial direction of the rotor, an elongated sealing piece and an elongated support piece disposed in said sealing groove in a superposed relationship substantially throughout their lengths with said sealing piece faced to the inner wall of the rotor housing, spring means disposed between the support piece and the sealing groove to bias the sealing and support pieces toward the inner wall of the rotor housing, corner seal means provided in each side surface of the rotor at each apex portion, said corner seal means comprising a corner seal recess formed in the side surface at each apex portion, a corner seal member fitted to the corner seal recess and having an axially extending slit for receiving an end portion of the apex seal means and spring means for biasing the corner seal member toward the inner wall of the side housing, at least a portion of said slit of the corner seal member being of a minimum width which is smaller than width of the sealing groove of the apex seal means, said portion of the minimum width of slit of the corner seal member being disposed against only one of the sealing and support pieces of the apex seal means. Where the corner seal member is of a relatively thin ring-shaped cross-sectional configuration, the longitudinal slit may be of a uniform width and may be placed only against the sealing piece. Where the corner seal member has a relatively large thickness at the slit, the slit may have a narrow portion of the minimum width and a wide portion which is larger in width than the sealing groove of the apex seal means. In this instance, the narrow portion may be placed against either the sealing piece or the support piece.

The minimum width portion of the longitudinal slit in the corner seal member may be defined by a pair of opposed parallel flat surfaces. One of the flat surfaces may then be located during a certain period of operation coplanar with one of the side walls of the sealing groove in the apex seal means and the other flat surface may be projected beyond the plane of the other side wall of the sealing groove. The corner seal member should preferably have resiliency in radial direction and fitted to the corner seal recess with a radially compressed condition so that it has a radially outwardly directed resiliency to thereby closely fit to the wall of the corner seal recess.

In practice, the apex seal means may be associated with a side piece at one or each end portion thereof as in conventional apex seals. Further, in order to produce sideward wedge forces, the sealing and support pieces may be superposed through sidewardly inclined interfaces.

The above and other objects and features of the present invention will become apparent from the following descriptions of preferred embodiments taking reference to the accompanying drawings, in which.

Figure 1:
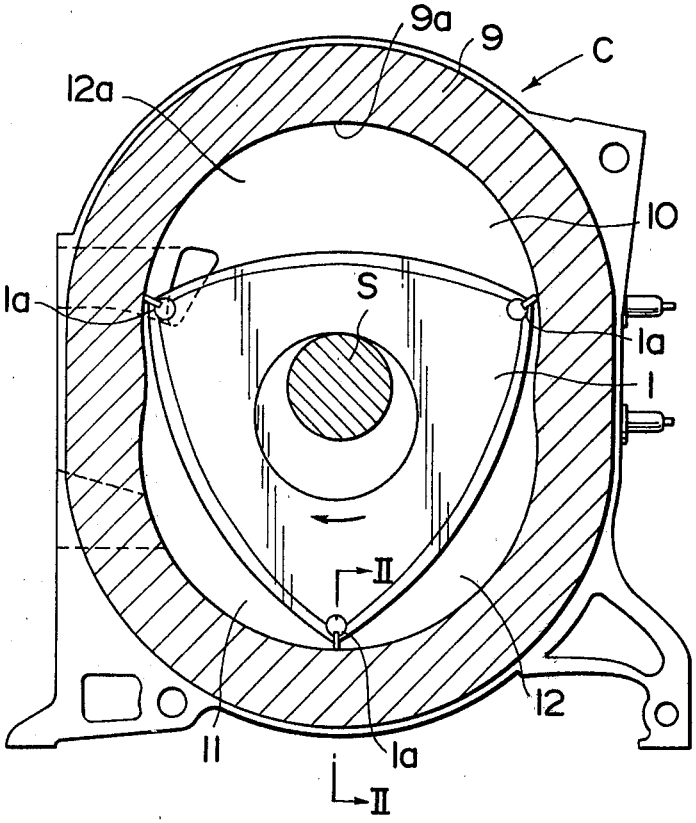
FIG. 1 is a sectional view of a rotary piston engine to which the present invention can be applied.

Referring now to the drawings, particularly to FIG. 1, the rotary piston engine shown therein includes a casing C comprised of a rotor housing 9 having an inner wall 9*a* of trochoidal configuration and a pair of side housings 10 having inner surfaces 10*a* and secured to the opposite sides of the rotor housing 9. In the casing C, there is disposed a rotor 1 of substantially triangular configuration which is carried by an eccentric shaft S for rotation with apex portions 1*a* in sliding contact with the inner wall 9*a* of the rotor housing 9 to define working chambers 11, 12 and 12*a*.

Figure 2:
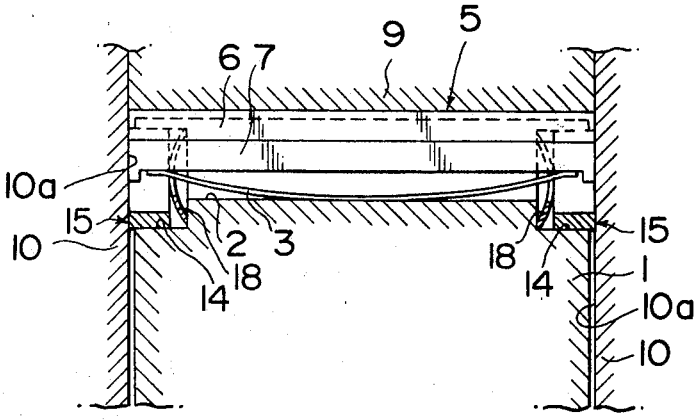
FIG. 2 is a sectional view taken substantially along the line II—II in FIG. 1.

Referring now to FIG. 2, in each apex portion 1*a*, the rotor 1 is formed with an axially extending sealing groove 2 for receiving an apex seal 5 therein. The apex seal 5 comprises an elongated sealing piece 6 and an elongated support piece 7. The sealing and support pieces 6 and 7 are disposed along the sealing groove 2 with a superposed relationship. A leaf spring 3 is provided in the groove 2 with its opposite ends in engagement with the support piece 7. Thus, the pieces 6 and 7 are resiliently forced toward the inner wall 9*a* of the rotor housing 9.

Figure 3:
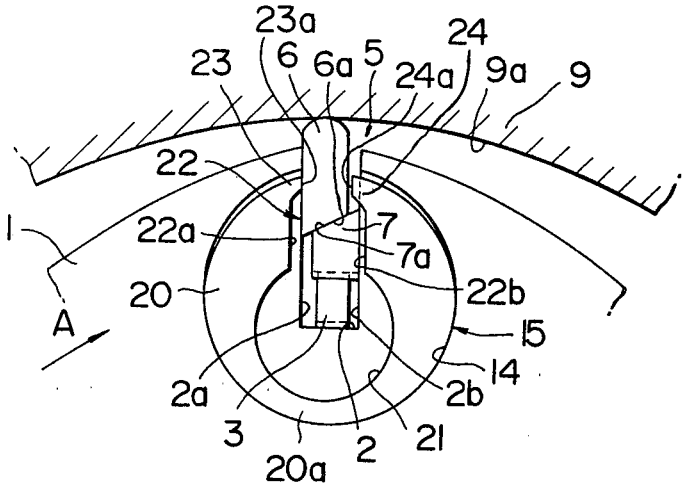
FIG. 3 is a side view showing the arrangement for the apex and corner seals; and, FIGS. 4 through 6 are side views similar to FIG. 3 but showing other embodiments.

At the opposite ends of the sealing groove 2, the rotor 1 is formed with corner seal recesses 14 for receiving corner seals 15. Referring also to FIG. 3, it will be noted that the corner seal 15 includes a cylindrical corner seal member 20 adapted to be fitted to the recess 14. The member 20 has a longitudinally extending slit 22 and a circular opening 21 which is eccentric with respect to the cylindrical outer surface of the member 20 so as to provide a thin resilient portion 20*a* at a position diametrically opposite to the slit 22. Thus, the member 20 has a radial resiliency and fitted to the recess 14 with a radially compressed condition so that it has a tendency of expanding radially outwardly. This provides a close contact between the outer surface of the corner seal member 20 and the recess 14 to establish a reliable seal. A leaf spring 18 is provided in the recess 14 for urging the corner seal member 20 toward the inner wall 10*a* of the side housing 10. The sealing and support pieces 6 and 7 of the apex seal 5 are received at each end by the slit 22 of the corner seal member 15. In the illustrated embodiment, the sealing and support pieces 6 and 7 respectively have sidewardly inclined surfaces 6*a* and 7*a* which are engaged with each other so that, when they are forced toward the inner wall surface 9*a* of the rotor housing 9 under the action of the spring 3, a sideward force is produced to urge the sealing piece 6 in one side and the support piece in the other side.

As shown in FIG. 3, the apex seal groove 2 has a pair of opposed parallel surfaces 2*a* and 2*b* and the sealing and support pieces 6 and 7 are respectively forced against the side walls 2*a* and 2*b* of the groove 2. The slit 22 is generally defined by a pair of parallel flat walls 22*a* and 22*b* which are spaced apart by a distance greater than the width of the groove 2 and receives end portions of the sealing and support pieces 6 and 7.

At the radially outward end of the slit 22, the side walls 22*a* and 22*b* are respectively formed with projections 23 and 24 which have opposing parallel flat surfaces 23*a* and 24*a*, respectively, to define a minimum width slit portion. The surfaces 23*a* and 24*a* are substantially parallel with the side walls 2*a* and 2*b*. The distance between the surfaces 23*a* and 24*a* is smaller than that between the side walls 2*a* and 2*b*. In the illustrated positions of the parts, the surface 23*a* is coplanar with the side wall 2*a* of the apex seal groove 2 and the surface 24*a* is projected beyond the plane of the side wall 2*b* so as to be placed against the sealing piece 6 with a slight clearance. It will thus be understood that the sealing piece 6 is sidewardly forced under the wedge action as provided by the slanted surfaces 6*a* and 7*a* into contact with the side wall 2*a* of the groove 2 and the surface 23*a* of the projection 23. Further, since the minimum width slit portion as defined by the surfaces 23*a* and 23*b* are located only against the sealing piece 6, the support piece 7 can also be forced into contact with the side wall 2*b* of the apex seal groove 2 without being disturbed by the projections in the corner seal member 20. It should further be noted that the minimum width slit portion is effective to restrict gas leakage through the gap between the apex seal and the slit in the corner seal member.

Figure 4:
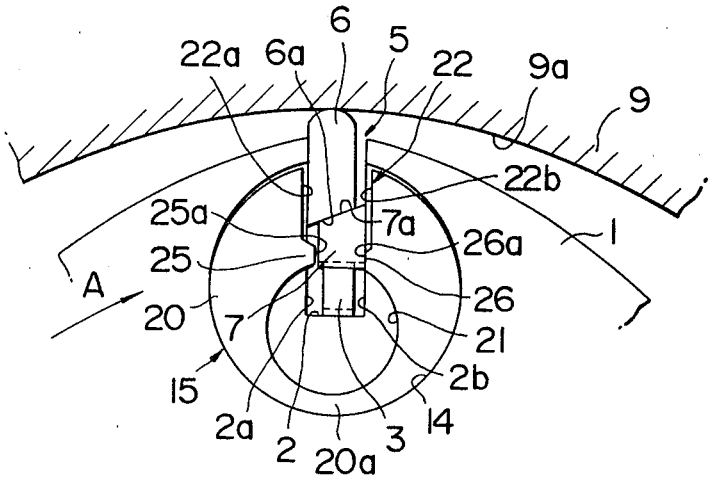

Referring now to FIG. 4, the embodiment shown therein is similar in arrangements to the previous embodiment so that corresponding parts are designated by the same reference numerals as in the previous embodiments. In the embodiment, in lieu of the projections 23 and 24 formed at the radial outward end of the slit 22 in the previous embodiment, the side walls 22*a* and 22*b* of the slit 22 are formed at the radially inward portions thereof with projections 25 and 26, respectively, which have opposed flat parallel surfaces 25*a* and 26*a* to define a minimum width slit portion. As in the previous embodiment, the slit 22 of this embodiment has a width which is generally greater than the width of the apex seal groove 2 but the minimum width slit portion is narrower than the groove 2. In the illustrated position of the parts, the surface 26*a* is coplanar with the side wall 2*b* of the groove 2 so that the support piece 7 is maintained in contact with the side wall 2*b* of the groove 2 and the surface 26*a* of the projection 26. The surface 25*a* of the projection 25 is located against the support piece 7 with a slight gap. Since the minimum width slit portion is located only against the support piece 7, the sideward movement of the sealing piece 6 is not disturbed.

Figure 5:
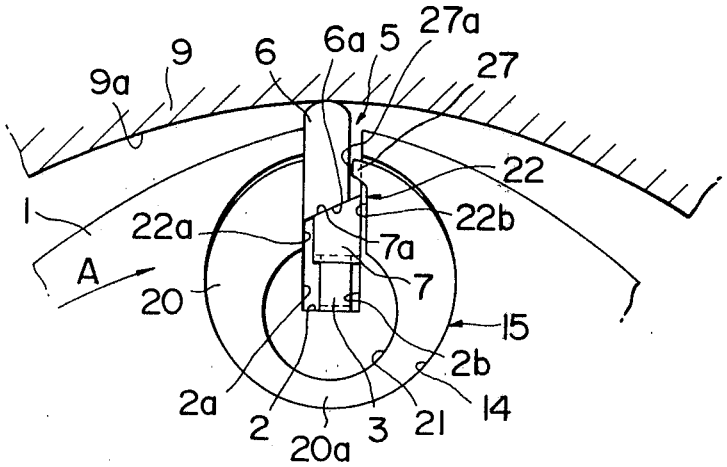

Referring to FIG. 5, the embodiment shown therein is different from the embodiment in FIG. 3 in that the minimum width slit portion is defined by a single projection 27 formed on the side wall 22*b* of the slit 22 at a radially outward end portion thereof. In the illustrated position of the parts, the side wall 22*a* of the slit 22 is coplanar with the side wall 2*a* of the apex seal groove 2 and the sealing piece 6 is maintained in contact with the side walls 2*a* and 22*a*. The projection 27 has a flat surface 27*a* which is located against the sealing piece 6 with a slight gap.

Figure 6:
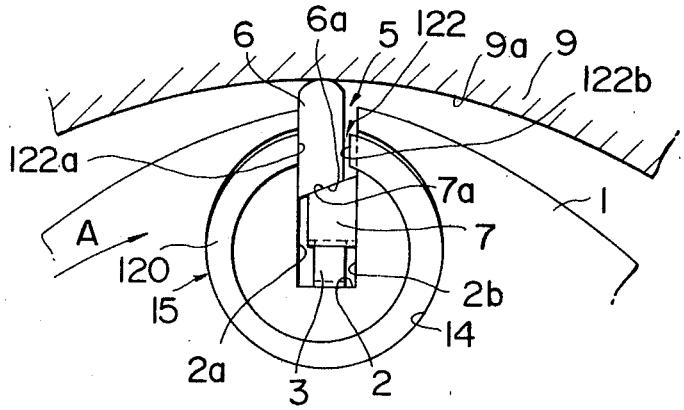

In FIG. 6, the embodiment shown therein includes a corner seal having a corner seal member 120 of a ring-shaped cross-sectional configuration having a relatively thin wall of substantially uniform thickness. A longitudinally extending slit 122 is formed to receive an end portion of the sealing piece 6. The slit 122 is defined by a pair of opposed flat surfaces 122*a* and 122*b* which are parallel with the side walls 2*a* and 2*b* and has a width which is smaller than the width of the apex seal groove 2. In the illustrated position, the surface 122*a* is coplanar with the side wall 2*a* of the groove 2 and the sealing piece 6 is in contact with the side wall 2*a* and the surface 122*a*. The surface 122*b* projects beyond the plane of the side wall 2*b* of the groove 2 and located against the sealing piece 6 with a slight gap. The support piece 7 is located out of the slit 122 so that its sideward movement is not restricted by the slit 122.

The invention has thus been shown and described with reference to specific embodiments, however, it should be noted that the invention is in no way limited to the details of the illustrated structures but changes and modifications may be made without departing from the scope of the appended claims. For example, the invention has been described with reference to such apex seal having no side pieces. However, the invention can also be applied to apex seals having side pieces. Further, the interface between the sealing and support pieces of the apex seal may not necessarily be sidewardly inclined.

I claim:

1. Rotary piston engine including a casing which comprises a rotor housing having an inner wall of trochoidal configuration and a pair of side housings having inner walls and secured to the opposite sides of the rotor housing to define a rotor cavity in the casing, a rotor of substantially polygonal configuration having opposite side surfaces and disposed in said rotor cavity for rotation with apex portions in sliding engagement with the inner wall of the rotor housing, apex seal means provided in each apex portion of the rotor and comprising a sealing groove formed in the rotor at the apex portion to extend in axial direction of the rotor, an elongated sealing piece and an elongated support piece disposed in said sealing groove in a superposed relationship substantially throughout their lengths with said sealing piece faced to the inner wall of the rotor housing, spring means disposed between the support piece and the sealing groove to bias the sealing and support pieces toward the inner wall of the rotor housing, corner seal means provided in each side surface of the rotor at each apex portion, said corner seal means comprising a corner seal recess formed in the side surface at each apex portion, a corner seal member of one piece construction fitted to the corner seal recess and having an axially extending slit for receiving an end portion of the apex seal means and spring means for biasing the corner seal member toward the inner wall of the side housing, said slit of the corner seal member having a narrow portion of a width which is smaller than width of the sealing groove of the apex seal means and a wide portion of a width which is not smaller than the width of the sealing groove of the apex seal means, said narrow portion of said slit of the corner seal member being opposed to only one of the sealing and support pieces of the apex seal means with a slight clearance therebetween.

2. Rotary piston engine in accordance with claim 1 in which said wide portion of said slit in the corner seal member is generally wider than the sealing groove of the apex seal means and said narrow portion of the slit of the corner seal member is defined by projection means formed in said slit and disposed only against the support piece.

3. Rotary piston engine in accordance with claim 1 in which said narrow portion of the slit of the corner seal member is defined by a pair of flat surfaces parallel with side walls of the sealing groove of the apex seal means.

4. Rotary piston engine in accordance with claim 1 in which said sealing and support pieces of the apex seal means are superposed through sidewardly slanted mating surfaces.

5. Rotary piston engine in accordance with claim 1 in which said wide portion of said slit in the corner seal member is generally wider than the sealing groove of the apex seal means and said narrow portion of the slit of the corner seal member is defined by projection means formed in said slit and disposed only against the sealing piece.

6. Rotary piston engine in accordance with claim 5 in which said projection means is formed only at one side of the slit.

7. Rotary piston engine in accordance with claim 1 in which said corner seal member has a cylindrical outer surface and a radial resiliency, said corner seal member being fitted to the corner seal recess with a radially inwardly compressed condition so that it has a tendency of expanding radially outwardly.

8. Rotary piston engine in accordance with claim 7 in which said corner seal member has an axial bore which is eccentric with respect to the cylindrical outer surface so that a resilient thin portion is defined to provide the radial resiliency.

* * * * *